United States Patent [19]

De Michieli

[11] 4,024,736

[45] May 24, 1977

[54] PRISONER RESTRAINER

[76] Inventor: William P. De Michieli, 6148 Brokenhurst Road, Indianapolis, Ind. 46220

[22] Filed: Apr. 16, 1976

[21] Appl. No.: 677,763

[52] U.S. Cl. ..... 70/16

[51] Int. Cl.[2] ..... E05B 73/00

[58] Field of Search ..... 70/14, 15, 16, 17, 18; 119/126, 128; 128/134

[56] References Cited

UNITED STATES PATENTS

| | | | |
|---|---|---|---|
| 787,430 | 4/1905 | Bonnel | 70/16 |
| 2,006,743 | 7/1935 | Nagle | 70/16 |
| 2,650,590 | 9/1953 | Moore | 128/134 |
| 3,426,559 | 2/1969 | Schubach | 70/16 |

*Primary Examiner*—Robert L. Wolfe

*Attorney, Agent, or Firm*—Woodard, Weikart, Emhardt & Naughton

[57] ABSTRACT

A strap is used as a connection between two cuffs or shackles for the ankles of a prisoner. The strap is of a length which permits the prisoner to take a normal walking stride. A strap rewind reel mounted to one of the shackles receives the strap thereon and winds and unwinds the strap as the distance between ankles decreases and increases during walking by the prisoner. An automatic lock on the reel prevents unwinding at a rate which would permit the prisoner to run.

5 Claims, 6 Drawing Figures

PRISONER RESTRAINER

BACKGROUND OF THE INVENTION

1. Field of the Invention

This invention relates generally to prisoner restraints, and more particularly to a restraint for preventing prisoners from running.

2. Description of the Prior Art

Leg shackles and chains are well known. During the movement of prisoners by law officers, there are advantages to having a prisoner capable of walking. Usually a prisoner who is being guarded while walking from place to place, is handcuffed. However, when he is not handcuffed to a vehicle or to a custodial officer, occasionally a prisoner will run away and escape.

Although I am aware that there are such things as leg or ankle shackles, I am not aware that there has ever been a satisfactory arrangement to permit prisoners to walk comparatively freely, but prevent them from running. It is therefore an object of my invention to provide means for facilitating the walking of a prisoner but preventing him from running, and thus avoiding the ease with which prisoners are able to escape in many instances at present.

SUMMARY OF THE INVENTION

Described briefly, is a typical embodiment of the present invention, a strap is provided between a pair of cuffs or shackles, with the strap being connected to one of the cuffs by means of a strap rewind reel having provisions therein to limit the speed of withdrawal of the strap from the reel, and thereby limit the speed with which the ankles can pass each other as the prisoner perambulates.

DESCRIPTION OF THE PREFERRED EMBODIMENT

Figure 1:
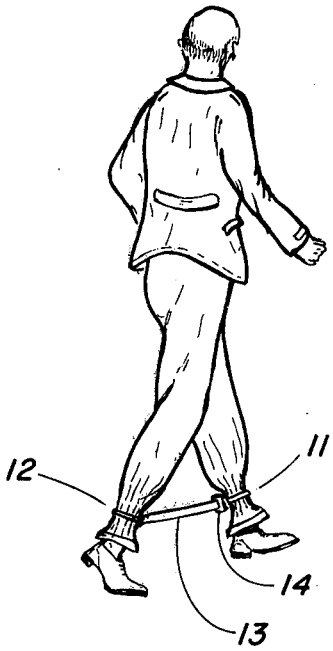
FIG. 1 is a symbolic view of a prisoner with the restraint secured to his ankles and with his ankles separated as during a normal walking step.

Referring now to FIG. 1, the prisoner is shown with the shackles 11 and 12 secured to his ankles, and the strap 13 extending between the shackle 12 and the strap rewind apparatus 14 connected to the shackle 11.

Figure 2:
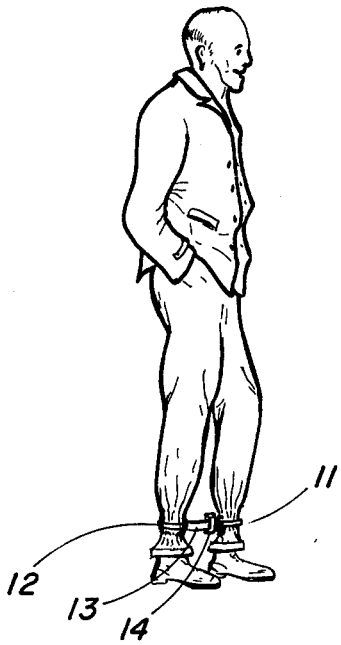
FIG. 2 is a similar view but with the ankles close together.

FIG. 2 shows the same components but with the strap almost entirely retracted by the rewind apparatus 14 as the prisoner's ankles are close together.

Figure 3:
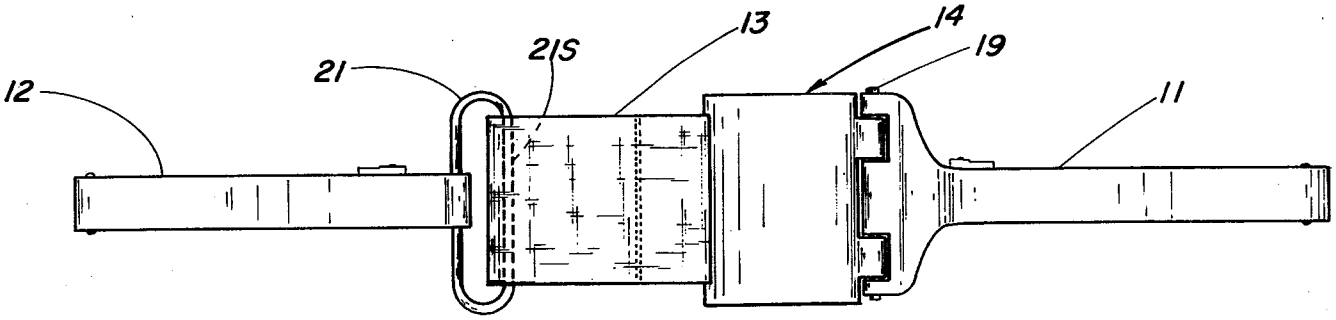
FIG. 3 is a front elevational enlarged view of the restrainer with the strap retracted.
Figure 4:
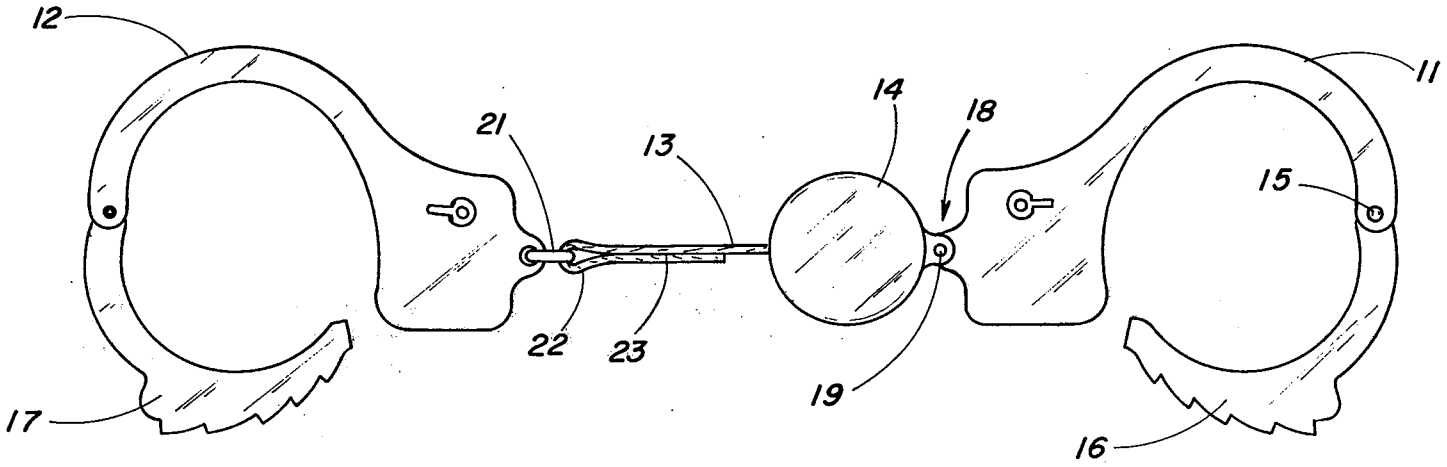
FIG. 4 is a top plan view thereof.

Referring now to FIG. 3 along with FIG. 4 the shackle is shown in each instance in the form of a conventional handcuff with the jaw 16 shown open on the cuff 11 and the jaw 17 shown open on cuff 12, for example. Other types of cuffs or shackles can be used also in the practice of this invention.

A hinge assembly 18 is provided for connection of the rewind apparatus 14 (which can be very similar to a conventional seat belt retractor assembly) to the cuff 11, with the hinge pin 19 peened at the top and bottom to prevent removal. In this way the rewind assembly 14 is pivoted with respect to the cuff 11. On the opposite cuff, a ring 21 is affixed thereto and receives the loop 22 of the strap 13, which is stitched at 23. This strap is wound on a reel in the rewind assembly 14. This reel is represented schematically at 24 in FIG. 5

Figure 5:
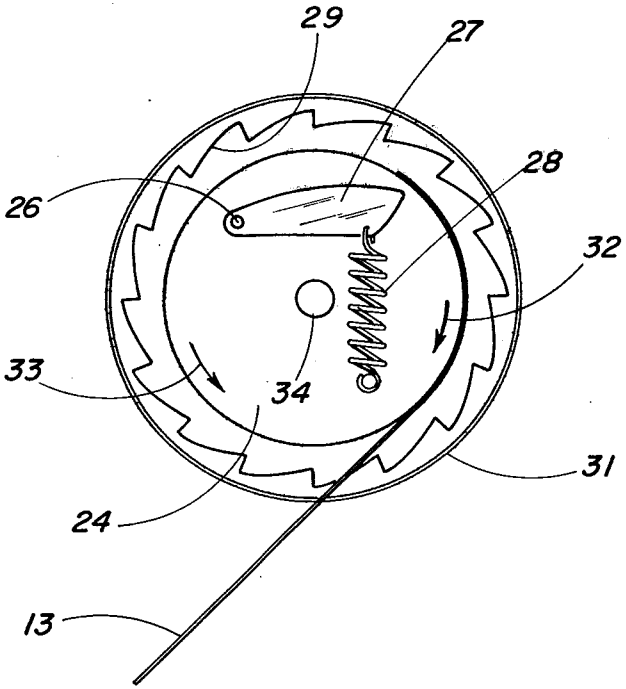
FIG. 5 is a section showing schematically the inertia or centrifugal lock.

Referring further to FIG. 5, the reel has a pin 26 pivotally mounting a dog or pawl 27 spring loaded by a spring 28 to keep it retracted away from the ratchet teeth 29 affixed to the inside of the housing 31 of the rewind assembly. Upon rotation of the reel 24 at a speed in excess of a certain amount, the pawl 27 will move outwardly due to centrifugal force, and against the resistance of spring 28, and will eventually contact the ratchet teeth 29. If the reel is rotating in the strap unwinding direction of arrow 32, the pawl will immediately lock against ratchet teeth and prevent further unwinding of the belt or strap 13. If the reel is rotating in the belt-winding direction of arrow 33, then the contact of the pawl with the ratchet will not prevent continued rotation because of the ability of the pawls moving in that direction to simply slide across the tops of the ratchet teeth.

Figure 6:
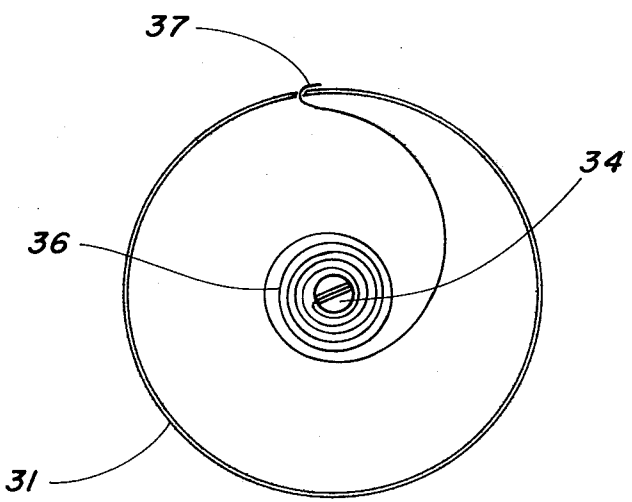
FIG. 6 is a section showing schematically the rewind spring.

FIG. 6, which is viewed in the same direction as FIG. 5 shows the reel shaft 34 (which may be keyed or otherwise secured to the reel 24) receiving one end of the rewind spring 36, the other end 37 of which is received in a slot in the housing 31. Therefore, when the reel is turning in the belt unwinding direction of arrow 32 of FIG. 5, the reel shaft 34 is winding up the spring 36. Then, when the strap tightening or pulling load has stopped pulling it, the bias in the spring 36 tending to unwind it, will turn the reel in the direction or arrow 33 and wind the strap back onto the reel.

Rewind assemblies of this kind are known, and are used widely for seat belt retractors for automobiles. In some such devices, the belt locking feature is employed to limit the rate of withdrawal of the belt from the retractor and thereby preclude injury in the case of collision, and yet enable the desired freedom of movement at low rates of movement. Accordingly, the strap 13 which can be used in the practice of the present invention, can be made of the same types of fabric as are currently being used in automotive seat belts, although other materials may be used. However, the term "strap" as used herein to describe and claim my invention should be understood to cover members having cross sectional shapes other than flat, and may include circular or other shapes.

The disposition of the pivot pin 19 parallel to the strap-receiving portion 21*s* (FIG. 3) of the belt ring, and parallel to the hinge pins such as 15 of the cuffs, facilitates reliable winding and unwinding of the strap as the person walks. It is believed that the maximum rate of withdrawal of the strap from the reel 24 should be limited to permit no greater walking speed than 350 feet per minute, to preclude a prisoner from running and yet permit normal walking rates. Thus the pawl and spring and ratchet relationships would be established to provide this.

If experience proves that the threshold between a walking gait and a running gait is greater or less than 350 feet per minute, the pawl return spring 28 may be replaced by a stiffer or weaker spring, respectively (secure, of course, from tampering). For most purposes, the maximum permissible spacing between ankles should be limited to thirty inches, center-to-center, to prevent the length of stride usually encountered in running adults. Therefore the maximum length of extension of the strap from the rewind apparatus 14 to ring 21 should be 26 inches.

While there have been described above the principles of this invention in connection with specific apparatus, it is to be clearly understood that this description is made only by way of example and not as limitation in the scope of the invention.

What is claimed is:

1. A prisoner restrainer comprising:

first and second ankle cuff members;

a strap winding apparatus connected to one of said members;

a strap connected to said winding apparatus and to the other of said members;

and means in said winding apparatus to limit the rate of unwinding of said strap therefrom.

2. The apparatus of claim 1 wherein:

the maximum length of extension of the strap is 26 inches to limit the maximum attainable spacing between centers of ankles in said members to 30 inches.

3. The apparatus of claim 1 wherein:

each of said members has an ankle receiving loop with an axis through the loop therein, said winding apparatus including a rewind mechanism having a reel therein with an axis parallel to said loop axis, said winding apparatus being hinged to said one of said cuff members on an axis parallel to said axes.

4. The apparatus of claim 3 wherein:

said winding apparatus has an automatic winding spring therein to rewind said strap into said mechanism, and said rate limiting means is capable of locking said mechanism to prevent unwinding of said belt upon attainment of walking rate greater than 350 feet per minute, said locking mechanism being a one-way lock to preclude any limit on strap rewinding speed, and said strap having a substantially flat cross section.

5. A method of restraining a prisoner and comprising the steps of:

securing a strap to the ankles of said prisoner, and securing a strap winding apparatus to the strap to permit unwinding of said strap for a normal walking gait but limit unwinding to prevent a normal running gait.

* * * * *